US012345115B2

(12) United States Patent
Fripp et al.

(10) Patent No.: US 12,345,115 B2
(45) Date of Patent: Jul. 1, 2025

(54) HEATERS TO ACCELERATE SETTING OF EXPANDABLE METAL

(71) Applicant: Halliburton Energy Services, Inc., Houston, TX (US)

(72) Inventors: Michael Linley Fripp, Carrollton, TX (US); Joachim Pihl, Sandefjord (NO); Arpana Verma, Coppell, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/151,331

(22) Filed: Jan. 18, 2021

(65) Prior Publication Data

US 2021/0222509 A1 Jul. 22, 2021

Related U.S. Application Data

(60) Provisional application No. 62/962,910, filed on Jan. 17, 2020.

(51) Int. Cl.
*E21B 33/12* (2006.01)

(52) U.S. Cl.
CPC ..... *E21B 33/1208* (2013.01)

(58) Field of Classification Search
CPC ..... E21B 33/1208; E21B 33/1212; E21B 36/008; E21B 36/00
See application file for complete search history.

(56) References Cited

U.S. PATENT DOCUMENTS 1,525,740 A 2/1925 Howard
2,075,912 A 4/1937 Roye
2,590,931 A * 4/1952 Cabaniss ..... E21B 37/02 166/170
2,743,781 A 5/1956 Lane
2,865,454 A 12/1958 Richards
3,206,536 A 9/1965 Goodloe
(Continued)

FOREIGN PATENT DOCUMENTS

CA 2820742 A1 9/2013
CN 203308412 U 11/2013
(Continued)

OTHER PUBLICATIONS

N A Surplice and R P Jones 1963 Br. J. Appl. Phys. 14 720 (Year: 1963).*
(Continued)

*Primary Examiner* — Theodore N Yao
(74) *Attorney, Agent, or Firm* — Scott Richardson; Parker Justiss, P.C.

(57) ABSTRACT

Provided is a method for setting a downhole tool, and a downhole localized heater. The method, in at least one aspect, includes positioning a downhole tool within a wellbore, the downhole tool including expandable metal configured to expand in response to hydrolysis, and positioning a downhole localized heater within the wellbore, the downhole localized heater being proximate the expandable metal. The method additionally includes subjecting the expandable metal to a wellbore fluid to expand the expandable metal into contact with one or more surfaces while activating the downhole localized heater to create a temperature spike and accelerate an expansion of the expandable metal.

16 Claims, 5 Drawing Sheets

(56) References Cited

U.S. PATENT DOCUMENTS 3,371,716 A 3/1968 Current
3,616,354 A 10/1971 Russell
3,706,125 A 12/1972 Hopkins
4,270,608 A 6/1981 Hendrickson
4,424,859 A 1/1984 Sims
4,424,861 A 1/1984 Carter
4,442,908 A 4/1984 Steenbock
4,446,932 A 5/1984 Hipp
4,457,379 A 7/1984 McStravick
4,527,815 A 7/1985 Frick
4,977,636 A 12/1990 King
4,979,585 A 12/1990 Chesnutt
5,139,274 A 8/1992 Oseman
5,220,959 A 6/1993 Vance
5,424,139 A 6/1995 Shuler
5,492,173 A 2/1996 Kilgore
5,517,981 A 5/1996 Taub et al.
5,662,341 A 9/1997 Ezell et al.
5,667,015 A 9/1997 Harestad
5,803,173 A 9/1998 Fraser et al.
6,089,320 A 7/2000 LaGrange
6,106,024 A 8/2000 Herman et al.
6,840,325 B2 1/2005 Stephenson
6,907,930 B2 6/2005 Cavender
6,942,039 B2 9/2005 Tinker
7,104,322 B2 9/2006 Whanger et al.
7,152,687 B2 12/2006 Gano
7,322,408 B2 1/2008 Howlett
7,347,274 B2 3/2008 Patel
7,350,590 B2 4/2008 Hosie et al.
7,402,277 B2 7/2008 Ayer
7,578,043 B2 8/2009 Simpson et al.
7,673,688 B1 3/2010 Jones
7,677,303 B2 3/2010 Coronado
7,696,275 B2 4/2010 Slay et al.
7,963,321 B2 6/2011 Kutac
7,996,945 B2 8/2011 Nosker
8,042,841 B2 10/2011 Viegener
8,109,339 B2 2/2012 Xu
8,225,861 B2 7/2012 Foster et al.
8,266,751 B2 9/2012 He
8,430,176 B2 4/2013 Xu
8,453,736 B2 6/2013 Constantine
8,459,367 B2 6/2013 Nutley et al.
8,469,084 B2 6/2013 Clark et al.
8,490,707 B2 7/2013 Robisson
8,579,024 B2 11/2013 Mailand et al.
8,684,096 B2 4/2014 Harris
8,794,330 B2 8/2014 Stout
8,807,209 B2 8/2014 King
8,875,800 B2 11/2014 Wood et al.
8,894,070 B2 11/2014 Bhat et al.
8,993,491 B2 3/2015 James
9,004,173 B2 4/2015 Richard
9,217,311 B2 12/2015 Slup
9,249,904 B2 2/2016 Duquette
9,279,295 B2 3/2016 Williamson et al.
9,347,272 B2 5/2016 Hewson et al.
9,353,606 B2 5/2016 Bruce et al.
9,393,601 B2 7/2016 Ranck
9,404,030 B2 8/2016 Mazyar
9,534,460 B2 1/2017 Watson et al.
9,611,715 B1 4/2017 Smith
9,644,459 B2 5/2017 Themig
9,708,880 B2 7/2017 Solhaug
9,725,979 B2 8/2017 Mazyar et al.
9,732,578 B2 8/2017 McRobb
9,745,451 B2 8/2017 Zhao et al.
9,765,595 B2 9/2017 Themig et al.
9,771,510 B2 9/2017 James et al.
9,945,190 B2 4/2018 Crowley
9,976,380 B2 5/2018 Davis et al.
9,976,381 B2 5/2018 Martin et al.
10,030,467 B2 7/2018 Al-Gouhi
10,060,225 B2 8/2018 Wolf
10,119,011 B2 11/2018 Zhao et al.
10,179,873 B1 1/2019 Meng
10,316,601 B2 6/2019 Walton et al.
10,337,298 B2 7/2019 Braddick
10,344,570 B2 7/2019 Steele
10,352,109 B2 7/2019 Sanchez
10,364,636 B2 7/2019 Davis
10,472,933 B2 11/2019 Steele
10,533,392 B2 1/2020 Walton et al.
10,718,183 B2 7/2020 Bruce et al.
10,758,974 B2 9/2020 Sherman
10,794,152 B2 10/2020 Lang et al.
10,961,804 B1 3/2021 Fripp
11,359,448 B2 6/2022 Fripp
11,365,611 B2 6/2022 Gibb
11,428,066 B2 8/2022 Andersen
11,512,552 B2 11/2022 Fripp
2002/0088616 A1 7/2002 Swor et al.
2003/0132001 A1 7/2003 Wilson
2003/0164236 A1 9/2003 Thornton
2003/0164237 A1 9/2003 Butterfield, Jr.
2003/0205377 A1 11/2003 Streater
2004/0194970 A1 10/2004 Eatwell
2005/0051333 A1 3/2005 Weber
2005/0061369 A1 3/2005 De Almeida
2005/0072576 A1 4/2005 Henriksen
2005/0093250 A1 5/2005 Santi et al.
2005/0199401 A1 9/2005 Patel et al.
2006/0144591 A1* 7/2006 Gonzalez ..... E21B 29/10 166/57
2006/0272806 A1 12/2006 Wilkie et al.
2007/0089875 A1 4/2007 Steele et al.
2007/0089910 A1 4/2007 Hewson et al.
2007/0095532 A1 5/2007 Head
2007/0137826 A1 6/2007 Bosma et al.
2007/0144734 A1 6/2007 Xu et al.
2007/0151724 A1 7/2007 Ohmer et al.
2007/0163781 A1 7/2007 Walker
2007/0221387 A1 9/2007 Levy
2007/0246213 A1 10/2007 Hailey
2007/0267824 A1 11/2007 Baugh et al.
2007/0277979 A1 12/2007 Todd et al.
2008/0047708 A1 2/2008 Spencer
2008/0135249 A1 6/2008 Fripp
2008/0149351 A1 6/2008 Marya
2008/0290603 A1 11/2008 Laflin
2009/0014173 A1 1/2009 Macleod
2009/0084555 A1 4/2009 Lee
2009/0102133 A1 4/2009 Ruddock
2009/0159278 A1* 6/2009 Corre ..... E21B 33/1277 166/57
2009/0200028 A1 8/2009 Dewar
2009/0250227 A1 10/2009 Brown et al.
2009/0250228 A1 10/2009 Loretz
2009/0272546 A1 11/2009 Nutley et al.
2009/0321087 A1 12/2009 Victorov
2010/0072711 A1 3/2010 Doane
2010/0078173 A1 4/2010 Buytaert et al.
2010/0096143 A1 4/2010 Angman
2010/0108148 A1 5/2010 Chen
2010/0122819 A1 5/2010 Wildman
2010/0139930 A1 6/2010 Patel
2010/0155083 A1 6/2010 Lynde et al.
2010/0181080 A1 7/2010 Levy
2010/0225107 A1 9/2010 Tverlid
2010/0257913 A1 10/2010 Storm, Jr. et al.
2010/0307737 A1 12/2010 Mellemstrand
2011/0061876 A1 3/2011 Johnson et al.
2011/0098202 A1* 4/2011 James ..... C09K 8/42 507/221
2011/0147014 A1 6/2011 Chen et al.
2012/0018143 A1 1/2012 Lembcke
2012/0048531 A1* 3/2012 Marzouk ..... E21B 36/001 166/57
2012/0048561 A1 3/2012 Holderman
2012/0048623 A1 3/2012 Lafuente et al.
2012/0049462 A1 3/2012 Pitman
2012/0168147 A1 7/2012 Bowersock
2012/0175134 A1 7/2012 Robisson

(56) References Cited

U.S. PATENT DOCUMENTS

2012/0273236 A1 11/2012 Gandikota et al.
2013/0048289 A1 2/2013 Mazyar et al.
2013/0056207 A1 3/2013 Wood et al.
2013/0081815 A1* 4/2013 Mazyar ..... E21B 36/008 166/302
2013/0152824 A1 6/2013 Crews
2013/0153236 A1 6/2013 Bishop
2013/0161006 A1 6/2013 Robisson et al.
2013/0186615 A1 7/2013 Hallunbaek et al.
2013/0192853 A1 8/2013 Themig
2013/0292117 A1 11/2013 Robisson
2014/0026335 A1 1/2014 Smith
2014/0034308 A1 2/2014 Holderman
2014/0051612 A1* 2/2014 Mazyar ..... E21B 33/12 507/269
2014/0262352 A1 9/2014 Lembcke
2015/0021049 A1 1/2015 Davis et al.
2015/0075768 A1 3/2015 Wright et al.
2015/0101813 A1 4/2015 Zhao
2015/0113913 A1 4/2015 Kim
2015/0184486 A1 7/2015 Epstein
2015/0233190 A1 8/2015 Wolf et al.
2015/0275587 A1 10/2015 Wolf et al.
2015/0337615 A1 11/2015 Epstein et al.
2015/0345248 A1 12/2015 Carragher
2015/0368990 A1 12/2015 Jewett
2015/0369003 A1 12/2015 Hajjari et al.
2016/0024896 A1 1/2016 Johnson et al.
2016/0024902 A1 1/2016 Richter
2016/0137912 A1 5/2016 Sherman et al.
2016/0138359 A1 5/2016 Zhao
2016/0145488 A1 5/2016 Aines et al.
2016/0145968 A1 5/2016 Marya
2016/0177668 A1 6/2016 Watson et al.
2016/0194936 A1 7/2016 Allen
2016/0208569 A1 7/2016 Anderson et al.
2016/0230495 A1 8/2016 Mazyar et al.
2016/0273312 A1 9/2016 Steele et al.
2016/0319633 A1 11/2016 Cooper et al.
2016/0326830 A1 11/2016 Hallundbaek
2016/0326849 A1 11/2016 Bruce
2016/0333187 A1 11/2016 Bauer et al.
2017/0015824 A1 1/2017 Gozalo
2017/0022778 A1 1/2017 Fripp et al.
2017/0107419 A1 4/2017 Roy et al.
2017/0107794 A1 4/2017 Steele
2017/0113275 A1 4/2017 Roy et al.
2017/0159401 A1 6/2017 Saltel et al.
2017/0175487 A1 6/2017 Marcin et al.
2017/0175488 A1 6/2017 Lisowski
2017/0191342 A1 7/2017 Turley
2017/0198191 A1 7/2017 Potapenko
2017/0234103 A1 8/2017 Frazier
2017/0306714 A1 10/2017 Haugland
2017/0314372 A1 11/2017 Tolman
2017/0350237 A1 12/2017 Giem et al.
2017/0356266 A1 12/2017 Arackakudiyil
2018/0023362 A1 1/2018 Makowiecki et al.
2018/0023366 A1 1/2018 Deng et al.
2018/0038193 A1 2/2018 Walton
2018/0080304 A1 3/2018 Cortez et al.
2018/0081468 A1 3/2018 Bruce et al.
2018/0086894 A1 3/2018 Roy
2018/0087350 A1* 3/2018 Sherman ..... E21B 43/086
2018/0094508 A1 4/2018 Smith et al.
2018/0100367 A1* 4/2018 Perez ..... E21B 29/02
2018/0128072 A1 5/2018 Larsen
2018/0128082 A1 5/2018 Hollan et al.
2018/0209234 A1 7/2018 Manera
2018/0223624 A1 8/2018 Fripp
2018/0298708 A1 10/2018 Schmidt et al.
2018/0334882 A1 11/2018 Brandsdal
2018/0347288 A1 12/2018 Fripp
2018/0363409 A1 12/2018 Frazier
2019/0016951 A1 1/2019 Sherman et al.
2019/0032435 A1 1/2019 Kochanek et al.
2019/0039126 A1 2/2019 Sherman
2019/0078414 A1 3/2019 Frazier
2019/0128092 A1 5/2019 Mueller et al.
2019/0136666 A1 5/2019 Kent
2019/0178054 A1 6/2019 Bruce
2019/0186228 A1 6/2019 Beckett et al.
2019/0225861 A1 7/2019 Reddy
2019/0249510 A1 8/2019 Deng et al.
2019/0316025 A1 10/2019 Sherman
2019/0383115 A1 12/2019 Lees
2020/0032574 A1 1/2020 Fripp et al.
2020/0056435 A1 2/2020 Sherman
2020/0072019 A1 3/2020 Onti et al.
2020/0080401 A1 3/2020 Sherman
2020/0080402 A1 3/2020 Lang et al.
2020/0240235 A1 7/2020 Fripp et al.
2020/0308945 A1 10/2020 Surjaatmadja et al.
2020/0325749 A1 10/2020 Fripp et al.
2020/0362224 A1 11/2020 Wellhoefer
2020/0370391 A1 11/2020 Fripp et al.
2021/0017835 A1 1/2021 Pelto et al.
2021/0040810 A1 2/2021 Evers
2021/0123310 A1 4/2021 Fripp et al.
2021/0123319 A1 4/2021 Greci
2021/0172286 A1 6/2021 Barlow
2021/0187604 A1 6/2021 Sherman et al.
2021/0270093 A1 9/2021 Fripp
2021/0270103 A1 9/2021 Greci et al.
2021/0332673 A1 10/2021 Fripp
2021/0363849 A1 11/2021 Al Yahya
2022/0106847 A1 4/2022 Dahl
2022/0186575 A1 6/2022 Fripp
2022/0205336 A1 6/2022 Asthana
2022/0372837 A1 11/2022 Holderman et al.

FOREIGN PATENT DOCUMENTS

CN 205422632 U 8/2016
CN 107148444 A 9/2017
CN 108194756 A 6/2018
CN 107148444 B 1/2019
CN 108194756 B 8/2020
EP 15726 A1 9/1980
EP 869257 A2 10/1998
EP 940558 A1 9/1999
EP 0940558 B1 1/2005
EP 1757770 A1 2/2007
EP 1910728 A1 4/2008
EP 1910728 B1 9/2009
EP 2447466 A2 5/2012
EP 2501890 A2 9/2012
EP 2501890 B 7/2014
EP 2447466 A3 3/2017
EP 3144018 A1 3/2017
EP 3144018 A4 5/2017
EP 3196402 A1 7/2017
EP 3144018 B1 9/2018
EP 2447466 B1 10/2018
GB 2444060 A 5/2008
GB 2444060 B 12/2008
JP 2003090037 A 3/2003
JP 2003293354 A 10/2003
JP 2004169303 A 6/2004
JP 2015175449 A 10/2015
KR 20020014619 A 2/2002
KR 20080096576 A 10/2008
WO 02/02900 A2 1/2002
WO 02/02900 A3 5/2002
WO 02/02900 A8 12/2003
WO 2005/022012 A1 3/2005
WO 2006/045794 A1 5/2006
WO 2007/047089 A1 4/2007
WO 2012/094322 A2 7/2012
WO 2012/125660 A2 9/2012
WO 2012/094322 A3 10/2012
WO 2012/125660 A3 2/2013
WO 2014/028149 A1 2/2014
WO 2014/182301 A1 11/2014

(56) References Cited

FOREIGN PATENT DOCUMENTS

| | | | |
|---|---|---|---|
| WO | 2014/193042 | A1 | 12/2014 |
| WO | 2015/057338 | A1 | 4/2015 |
| WO | 2015/069886 | A2 | 5/2015 |
| WO | 2015/069886 | A3 | 9/2015 |
| WO | 2015/183277 | A1 | 12/2015 |
| WO | 2016/000068 | A1 | 1/2016 |
| WO | 2016/171666 | A1 | 10/2016 |
| WO | 2017/100417 | A1 | 6/2017 |
| WO | 2018/055382 | A1 | 3/2018 |
| WO | 2019/094044 | A1 | 5/2019 |
| WO | 2019/122857 | A1 | 6/2019 |
| WO | 2019/147285 | A1 | 8/2019 |
| WO | 2019/151870 | A1 | 8/2019 |
| WO | 2019/164499 | A1 | 8/2019 |
| WO | 2020/005252 | A1 | 1/2020 |
| WO | 2020/141203 | A1 | 7/2020 |
| WO | 2019/164499 | A8 | 8/2020 |
| WO | 2020/167288 | A1 | 8/2020 |
| WO | 2020/204940 | A1 | 10/2020 |
| WO | 2021/034325 | A1 | 2/2021 |
| WO | 2021/086317 | A1 | 5/2021 |
| WO | 2021/096519 | A1 | 5/2021 |
| WO | 2021/126279 | A1 | 6/2021 |

OTHER PUBLICATIONS

Fripp, Michael, and Zachary Walton. "Degradable Metal for Use in a Fully Dissolvable Frac Plug." Paper presented at the Offshore Technology Conference, Houston, Texas, USA, May 2016. doi: https://doi.org/10.4043/27187-MS (Year: 2016).*

Merchant B. Gold, the noble metal and the paradoxes of its toxicology. Biologicals. Mar. 1998;26(1):49-59. doi: 10.1006/biol 1997.0123. PMID: 9637749. (Year: 1998).*

Fripp, et al. "Novel Expanding Metal Alloy for Non-Elastomeric Sealing and Anchoring." Paper presented at the SPE Annual Technical Conference and Exhibition, Houston, Texas, USA, Oct. 2022. doi: https://doi.org/10.2118/210273-MS (Year: 2022).*

* cited by examiner

HEATERS TO ACCELERATE SETTING OF EXPANDABLE METAL

CROSS-REFERENCE TO RELATED APPLICATION

This application claims the benefit of U.S. Provisional Application Ser. No. 62/962,910, filed on Jan. 17, 2020, entitled "HEATERS TO ACCELERATE SETTING OF EXPANDABLE METAL," commonly assigned with this application and incorporated herein by reference in its entirety.

BACKGROUND

Wellbores are drilled into the earth for a variety of purposes including accessing hydrocarbon bearing formations. A variety of downhole tools may be used within a wellbore in connection with accessing and extracting such hydrocarbons. Throughout the process, it may become necessary to isolate sections of the wellbore in order to create pressure zones. Downhole tools, such as frac plugs, bridge plugs, packers, and other suitable tools, may be used to isolate wellbore sections.

The aforementioned downhole; tools are commonly run into the wellbore on a conveyance, such as a wireline, work string or production tubing. Such tools often have either an internal or external setting tool, which is used to set the downhole tool within the wellbore and hold the tool in place, and thus function as a wellbore anchor. The wellbore anchors typically include a plurality of slips, which extend outwards when actuated to engage and grip a casing within a wellbore or the open hole itself, and a sealing assembly, which extends outwards to seal off the flow of liquid around the downhole tool.

BRIEF DESCRIPTION

Reference is now made to the following descriptions taken in conjunction with the accompanying drawings, in which.

DETAILED DESCRIPTION

Figure 1:
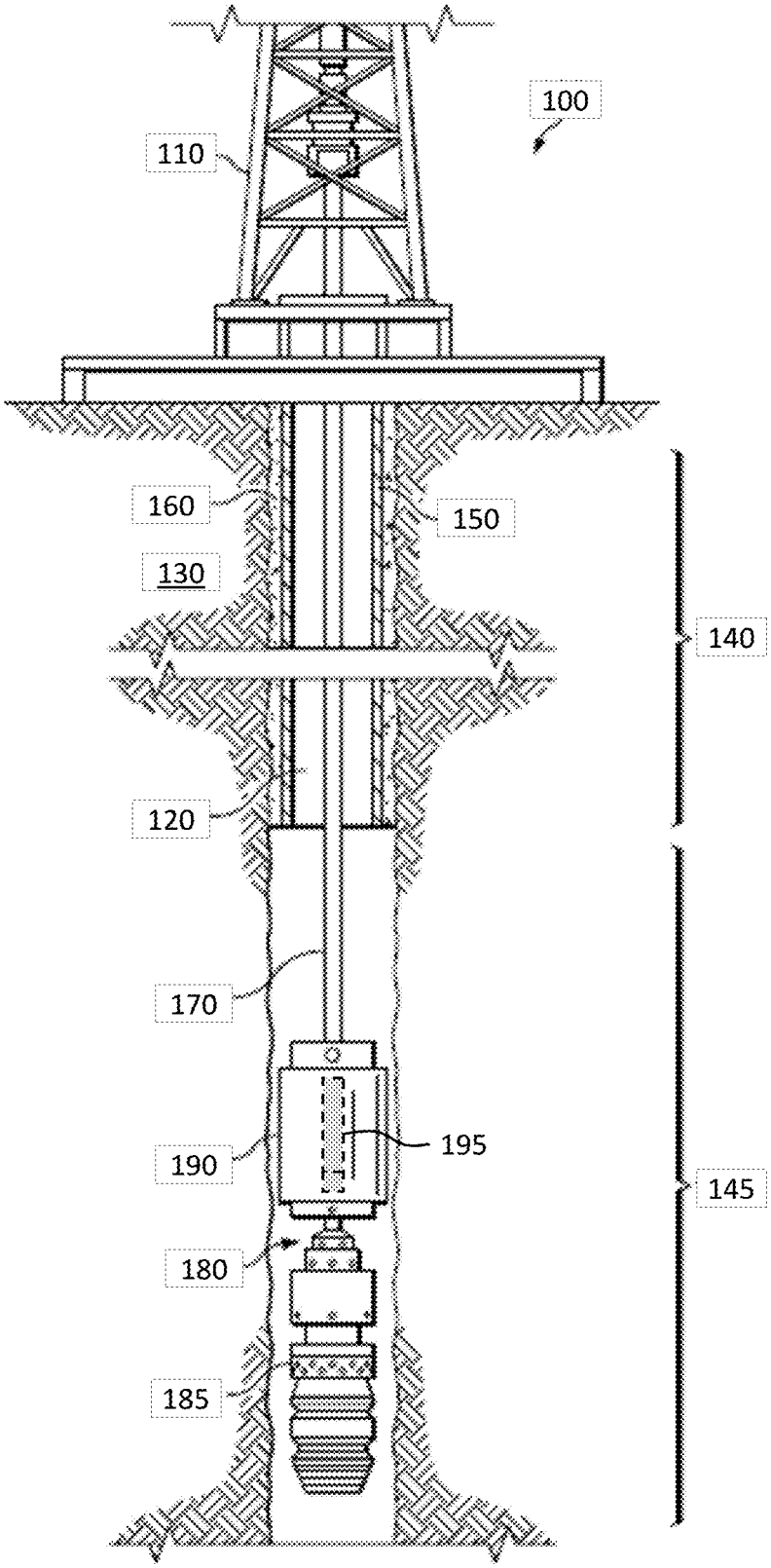
FIGS. 1-2 illustrate perspective views of alternative embodiments of well systems including an exemplary operating environment that the apparatuses, systems and methods disclosed herein may be employed.

In the drawings and descriptions that follow, like parts are typically marked throughout the specification and drawings with the same reference numerals, respectively. The drawn figures are not necessarily, but may be, to scale. Certain features of the disclosure may be shown exaggerated in scale or in somewhat schematic form and some details of certain elements may not be shown in the interest of clarity and conciseness.

The present disclosure may be implemented in embodiments of different forms. Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results. Moreover, all statements herein reciting principles and aspects of the disclosure, as well as specific examples thereof, are intended to encompass equivalents thereof. Additionally, the term, "or," as used herein, refers to a non-exclusive or, unless otherwise indicated.

Unless otherwise specified, use of the terms "connect," "engage," "couple," "attach," or any other like term describing an interaction between elements is not meant to limit the interaction to direct interaction between the elements and may also include indirect interaction between the elements described.

Unless otherwise specified, use of the terms "up," "upper," "upward," "uphole," "upstream," or other like terms shall be construed as generally toward the surface of the well; likewise, use of the terms "down," "lower," "downward," "downhole," or other like terms shall be construed as generally toward the bottom, terminal end of a well, regardless of the wellbore orientation. Use of any one or more of the foregoing terms shall not be construed as denoting positions along a perfectly vertical or horizontal axis. Unless otherwise specified, use of the term "subterranean formation" shall be construed as encompassing both areas below exposed earth and areas below earth covered by water, such as ocean or fresh water.

Referring to FIG. 1, depicted is a perspective view of a well system 100 including an exemplary operating environment that the apparatuses, systems and methods disclosed herein may be employed. For example, the well system 100 could use an expandable metal downhole tool according to any of the embodiments, aspects, applications, variations, designs, etc. disclosed in the following paragraphs. The term downhole tool, as used herein and without limitation, includes frac plugs, bridge plugs, packers, and other tools for fluid isolation, as well as wellbore anchors, among other downhole tools employing expandable metal.

The well system 100 illustrated in FIG. 1 includes a rig 110 extending over and around a wellbore 120 formed in a subterranean formation 130. As those skilled in the art appreciate, the wellbore 120 may be fully cased, partially cased, or an open hole wellbore. In the illustrated embodiment of FIG. 1, the wellbore 120 is partially cased, and thus includes a cased region 140 and an open hole region 145. The cased region 140, as is depicted, may employ casing 150 that is held into place by cement 160.

The well system 100 illustrated in FIG. 1 additionally includes a downhole conveyance 170 deploying a downhole tool assembly 180 within the wellbore 120. The downhole conveyance 170 can be, for example, tubing-conveyed, wireline, slickline, work string, or any other suitable means for conveying the downhole tool assembly 180 into the wellbore 120. In one particular advantageous embodiment, the downhole conveyance 170 is American Petroleum Institute "API" pipe.

The downhole tool assembly 180, in the illustrated embodiment, includes a downhole tool 185 and a wellbore anchor 190. The downhole tool 185 may comprise any downhole tool that could be positioned within a wellbore.

Certain downhole tools that may find particular use in the well system 100 include, without limitation, sealing elements, sealing packers, elastomeric sealing packers, non-elastomeric sealing packers (e.g., including plastics such as PEEK, metal packers such as inflatable metal packers, as well as other related packers), liners, an entire lower completion, one or more tubing strings, one or more screens, one or more production sleeves, etc. The wellbore anchor 190 may comprise any wellbore anchor that could anchor the downhole tool 185 within a wellbore. In certain embodiments, the downhole tool 185 is deployed without the wellbore anchor 190, and in certain other embodiments the wellbore anchor 190 is deployed without the downhole tool 185.

In accordance with the disclosure, at least a portion of the downhole tool 185 or the wellbore anchor 190 may include expandable metal, or an expandable metal and polymer composite. In some embodiments, all or part of the downhole tool 185 or the wellbore anchor 190 may be fabricated using expandable metal configured to expand in response to hydrolysis. The expandable metal, in some embodiments, may be described as expanding to a cement-like material. In other words, the expandable metal goes from metal to micron-scale particles and then these particles expand and lock together to, in essence, fix the downhole tool 185 or the wellbore anchor 190 in place. The reaction may, in typical situations take up to 90 days or more to fully react, depending on the reactive fluid and downhole temperatures. Nevertheless, the time of reaction may be significantly reduced, as discussed in the embodiments detailed below.

In some embodiments the reactive fluid may be a brine solution such as may be produced during well completion activities, and in other embodiments, the reactive fluid may be one of the additional solutions discussed herein. The expandable metal, pre-expansion, is electrically conductive in certain embodiments. The expandable metal may be machined to any specific size/shape, extruded, formed, cast or other conventional ways to get the desired shape of a metal, as will be discussed in greater detail below. The expandable metal, pre-expansion, in certain embodiments has a yield strength greater than about 8,000 psi, e.g., 8,000 psi+/−50%. In other embodiments, the expandable metal is a slurry of expandable metal particles. In other embodiments, the expandable metal is a composite of metal and polymers.

The hydrolysis of any metal can create a metal hydroxide. The formative properties of alkaline earth metals (Mg—Magnesium, Ca—Calcium, etc.) and transition metals (Zn—Zinc, Al—Aluminum, etc.) under hydrolysis reactions demonstrate structural characteristics that are favorable for use with the present disclosure. Hydration results in an increase in size from the hydration reaction and results in a metal hydroxide that can precipitate from the fluid.

The hydration reactions for magnesium is:

$$Mg+2H_2O \rightarrow Mg(OH)_2+H_2,$$

where $Mg(OH)_2$ is also known as brucite. Another hydration reaction uses aluminum hydrolysis. The reaction forms a material known as Gibbsite, bayerite, and norstrandite, depending on form. The hydration reaction for aluminum is:

$$Al+3H_2O \rightarrow Al(OH)_3+3/2H_2.$$

Another hydration reactions uses calcium hydrolysis. The hydration reaction for calcium is:

$$Ca+2H_2O \rightarrow Ca(OH)_2+H_2,$$

Where $Ca(OH)_2$ is known as portlandite and is a common hydrolysis product of Portland cement. Magnesium hydroxide and calcium hydroxide are considered to be relatively insoluble in water. Aluminum hydroxide can be considered an amphoteric hydroxide, which has solubility in strong acids or in strong bases.

In an embodiment, the expandable metal used can be a metal alloy. The metal alloy can be an alloy of the base metal with other elements in order to either adjust the strength of the metal alloy, to adjust the reaction time of the metal alloy, or to adjust the strength of the resulting metal hydroxide byproduct, among other adjustments. The metal alloy can be alloyed with elements that enhance the strength of the metal such as, but not limited to, Al—Aluminum, Zn—Zinc, Mn—Manganese, Zr—Zirconium, Y—Yttrium, Nd—Neodymium, Gd—Gadolinium, Ag—Silver, Ca—Calcium, Sn—Tin, and Re—Rhenium, Cu—Copper. In some embodiments, the alloy can be alloyed with a dopant that promotes corrosion, such as Ni—Nickel, Fe—Iron, Cu—Copper, Co—Cobalt, Ir—Iridium, Au—Gold, C—Carbon, gallium, indium, mercury, bismuth, tin, and Pd—Palladium. The metal alloy can be constructed in a solid solution process where the elements are combined with molten metal or metal alloy. Alternatively, the metal alloy could be constructed with a powder metallurgy process. The expandable metal can be cast, forged, extruded, pressed, a combination thereof, or may be a slurry of expandable metal particles.

Optionally, non-expanding components may be added to the starting expandable metal. For example, ceramic, elastomer, glass, or non-reacting metal components can be embedded in the expandable metal or coated on the surface of the metal. Alternatively, the starting expandable metal may be the metal oxide. For example, calcium oxide (CaO) with water will produce calcium hydroxide in an energetic reaction. Due to the higher density of calcium oxide, this can have a 260% volumetric expansion where converting 1 mole of CaO goes from 9.5 cc to 34.4 cc of volume. In one variation, the expandable metal is formed in a serpentinite reaction, a hydration and metamorphic reaction. In one variation, the resultant material resembles a mafic material. Additional ions can be added to the reaction, including silicate, sulfate, aluminate, and phosphate. The expandable metal can be alloyed to increase the reactivity or to control the formation of oxides.

The expandable metal can be configured in many different fashions, as long as an adequate volume of material is available for fully expanding. For example, the expandable metal may be formed into a single long tube, multiple short tubes, rings, alternating steel and swellable rubber and expandable metal rings, among others. Additionally, a coating may be applied to one or more portions of the expandable metal to delay the expanding reactions.

In application, the downhole tool assembly 180 can be moved down the wellbore 120 via the downhole conveyance 170 to a desired location. Once the downhole tool assembly 180, including the downhole tool 185 and/or the wellbore anchor 190 reaches the desired location, one or both of the downhole tool 185 and/or the wellbore anchor 190 may be set in place according to the disclosure. In one embodiment, one or both of the downhole tool 185 and/or the wellbore anchor 190 include the expandable metal, and thus are subjected to a wellbore fluid sufficient to expand the one or more expandable members into contact with a nearby surface, and thus in certain embodiments seal or anchor the one or more downhole tools within the wellbore.

In the embodiment of FIG. 1, the downhole tool 185 and/or the wellbore anchor 190 are positioned in the open hole region 145 of the wellbore 120. The downhole tool 185 and/or the wellbore anchor 190 including the expandable metal are particularly useful in open hole situations, as the expandable metal is well suited to adjust to the surface irregularities that may exist in open hole situations. Moreover, the expandable metal, in certain embodiments, may penetrate into the formation of the open hole region 145 and create a bond into the formation, and thus not just at the surface of the formation. Notwithstanding the foregoing, the downhole tool 185 and/or the wellbore anchor 190 are also suitable for a cased region 140 of the wellbore 120.

In certain embodiments, it is desirable or necessary to accelerate the expansion of the expandable metal. The present disclosure has recognized that increased temperatures may be used to accelerate the expansion process, and thus accelerate the setting of any downhole tool including the expandable metal. For example, the present disclosure has recognized that a downhole localized heater 195 may be used to provide a localized temperature spike to accelerate the expansion process, for example by way of an acceleration of the galvanic reaction. Accordingly, in certain embodiments, the expandable metal may be set on command, for example as easily as hitting a button that enables the downhole localized heater. The ability to set the expandable metal on command has increasing importance for creating packers, liner coupling, multilateral junctions, anchors, and downhole seals, among other downhole tools and/or features including expandable metal.

In accordance with one embodiment of the disclosure, a downhole localized heater 195 is positioned proximate the one or more expandable members. The downhole localized heater 195, in this embodiment, is configured to provide a localized temperature spike to accelerate the expansion process of the one or more expandable members, for example by way of an acceleration of the galvanic reaction. The term temperature spike, as used herein, means the downhole localized heater 195 is configured to provide an increase (e.g., localized increase) in temperature of at least 10° C. In yet another embodiment, the downhole localized heater 195 is configured to provide a temperature spike of at least 25° C. In yet another embodiment, the downhole localized heater 195 is configured to provide a temperature spike of at least 50° C. In yet another embodiment, the downhole localized heater 195 is configured to provide a temperature spike of at least 100° C. In one embodiment, the downhole localized heater 195 accelerates the expansion process by up to at least 2×. In another embodiment, the downhole localized heater 195 accelerates the expansion process by up to at least 5×. In yet another embodiment, the downhole localized heater 195 accelerates the expansion process by up to at least 10×, and in yet another embodiment of 20× or 100×, or more.

Figure 2:
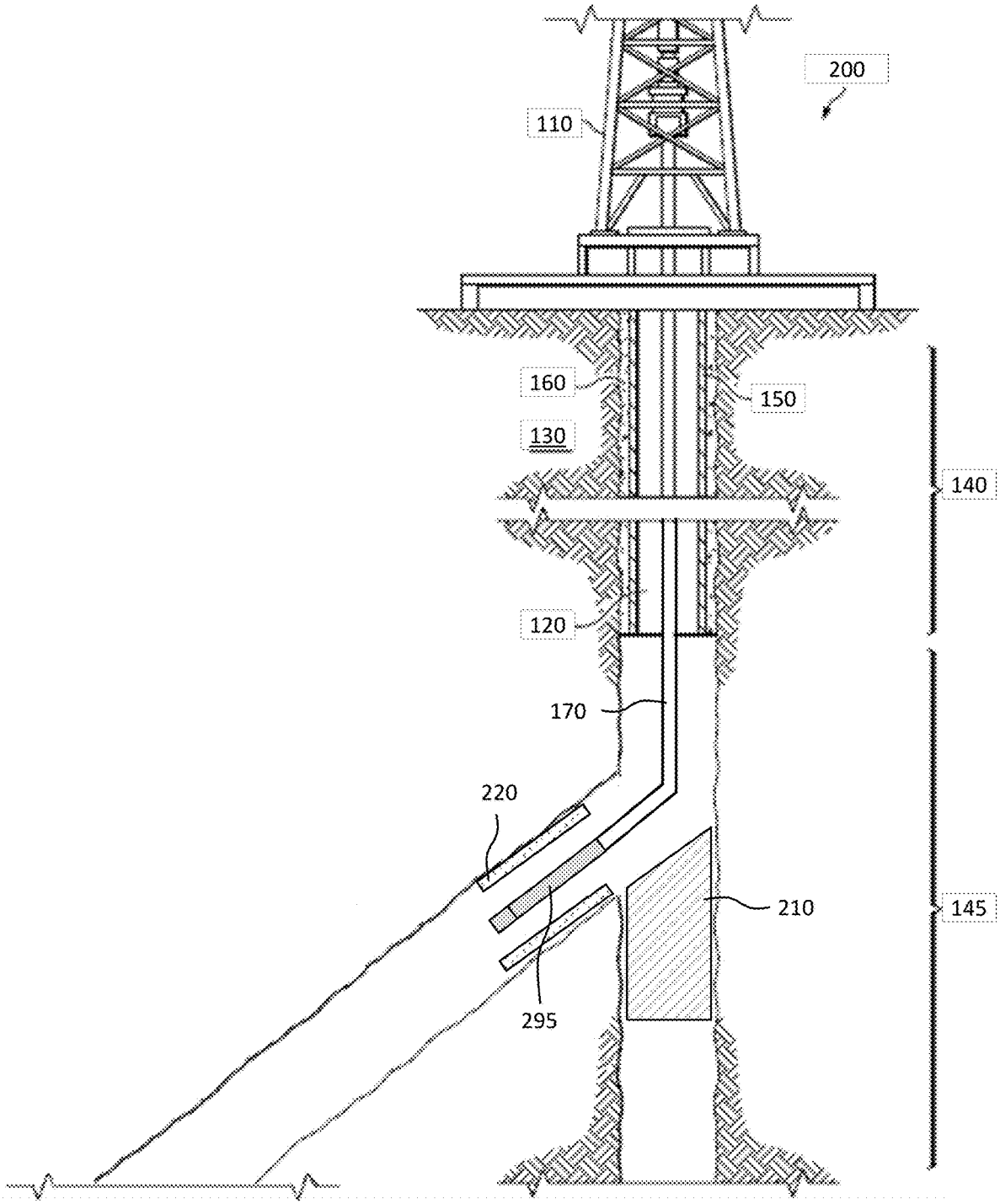

Turning to FIG. 2, depicted is a perspective view of a well system 200 including an alternative embodiment of an exemplary operating environment that the apparatuses, systems and methods disclosed herein may be employed. The well system 200 shares many of the same features as the well system 100. Accordingly, like reference numbers have been used to illustrate similar, if not identical, features. The well system 200 differs, for the most part, from the well system 100, in that the well system 200 includes a multilateral junction, including a whipstock 210 and expandable metal 220 positioned proximate thereto.

The well system 200 additionally includes a downhole localized heater 295 positioned proximate the expandable metal 220. The downhole localized heater 295, in this embodiment, is configured to provide a localized temperature spike to accelerate the expansion process of the expandable metal 220, for example by way of an acceleration of the galvanic reaction. The downhole localized heater 295 is illustrated in FIG. 2 as being deployed on the downhole conveyance 170, which may comprise wireline, slickline, coiled tubing, or a pump down tool, among others. Other embodiments may exist wherein the downhole localized heater 295 is positioned on an outside of the wellbore casing proximate the expandable metal. In such an instance the downhole conveyance 170 is not necessary to deploy the downhole localized heater 295.

Figure 3:
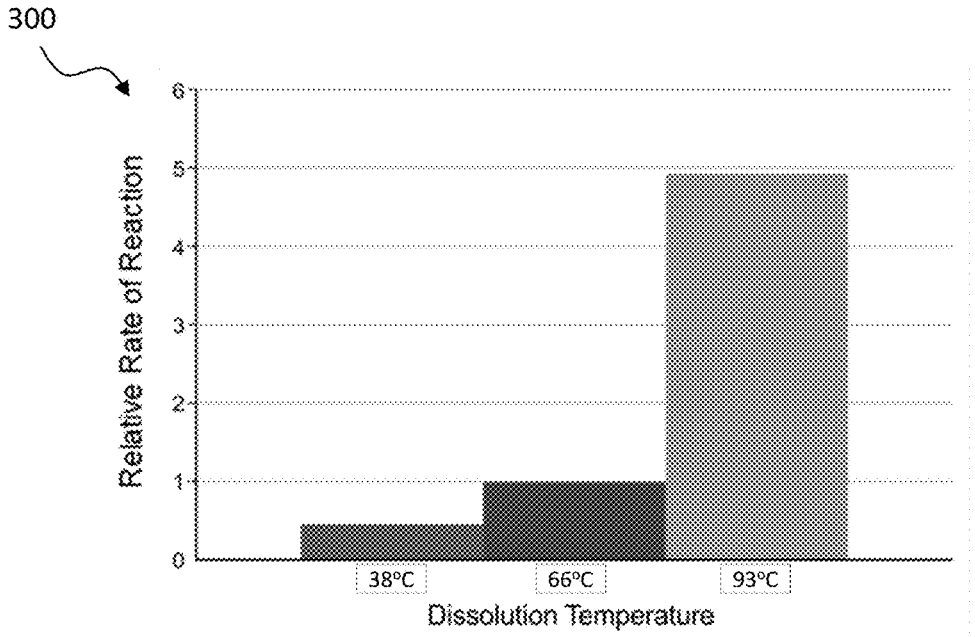
FIG. 3 illustrates a graph showing the relative rate of reaction for the expandable metals versus the dissolution temperature.

Turning briefly to FIG. 3, illustrated is a graph 300 showing the relative rate of reaction for the expandable metals versus the dissolution temperature. As is evident from FIG. 3, the relative rate of reaction increases substantially (e.g., possibly exponentially) as the dissolution temperature increases. For example, at a dissolution temperature of about 38° C. (e.g., about 100° F.) the relative rate of reaction is about 0.5. However, at a dissolution temperature of about 66° C. (e.g., about 150° F.) the relative rate of reaction is about 1, and moreover at a dissolution temperature of about 93° C. (e.g., about 200° F.) the relative rate of reaction is almost 5.

Figure 4:
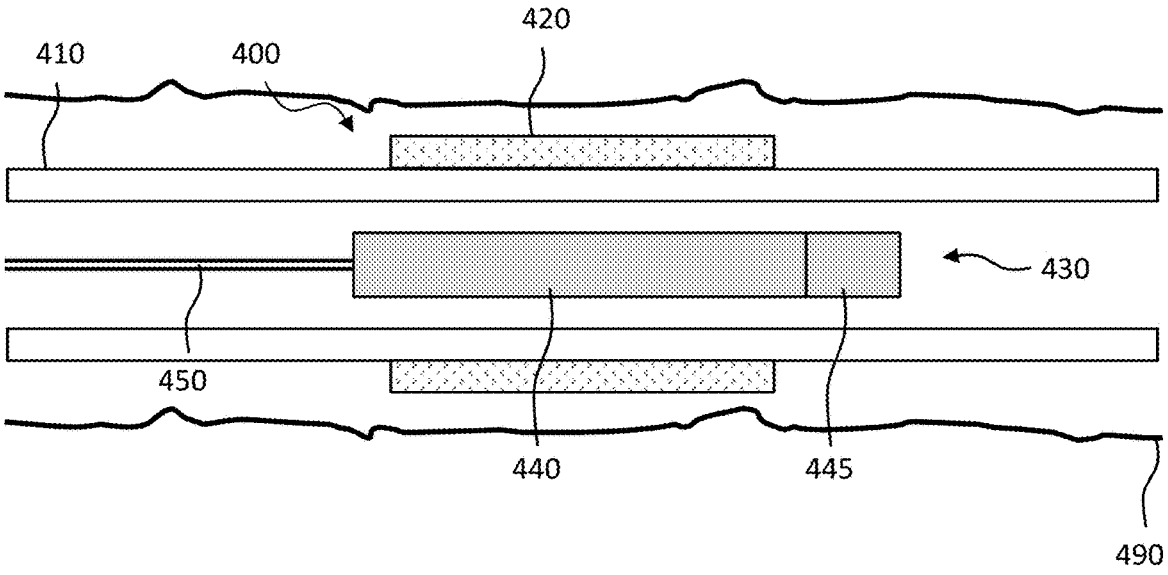
FIG. 4 illustrates a downhole tool (e.g., packer, plug, anchor, etc.) positioned within a wellbore.

Turning to FIG. 4, illustrated is a downhole tool 400 (e.g., packer, plug, anchor, etc.) positioned within a wellbore 490. The downhole tool 400 includes a downhole tubular 410 having expandable metal 420 on a surface thereof. In the illustrated embodiment, the downhole tubular 410 is wellbore casing and the expandable metal 420 is one or more expandable members positioned on an exterior surface thereof. Nevertheless, it should be understood that any downhole application and use of an expandable metal is within the scope of the present disclosure, including applications for multilateral junctions.

In the illustrated embodiment of FIG. 4, the downhole tubular 410 and the expandable metal 420 have a downhole localized heater 430 positioned therein. The downhole localized heater 430 may be any known or hereafter discovered heater for locally heating the expandable metal 420, and thus accelerating the expansion thereof, including a mechanical heater, chemical heater, electrical heater, etc. In the illustrated embodiment of FIG. 4, the downhole localized heater 430 includes a heating section 440 and a control section 445, both of which are deployed downhole within the downhole tubular 410 using a conveyance 450, such as wireline, slickline, coiled tubing, or another suitable conveyance. In the embodiment illustrated in FIG. 4, the control section 445 includes a power source and a controller that collectively activate the heating section 440.

Figure 5:
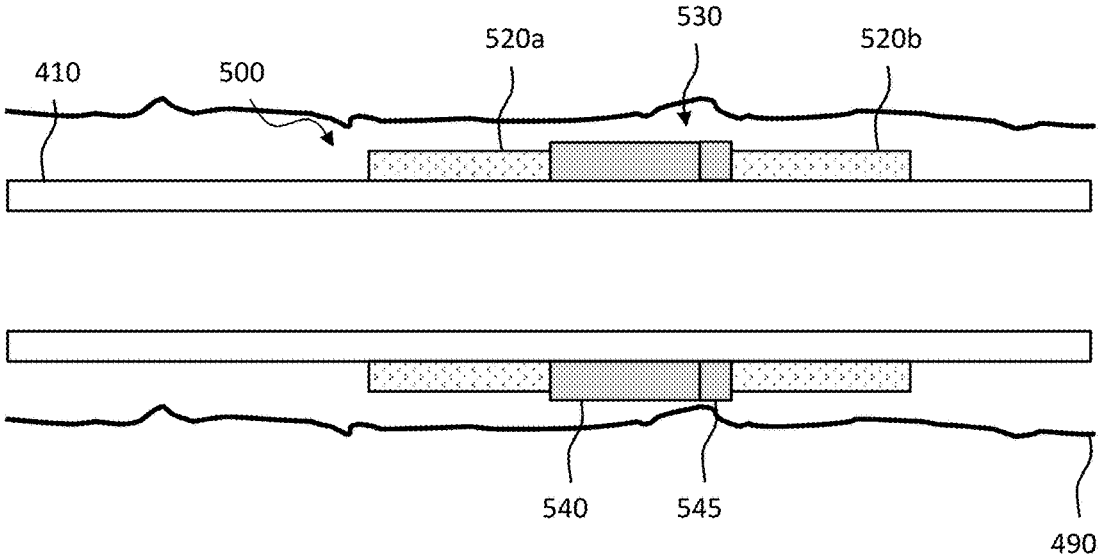
FIG. 5 illustrates an alternative embodiment of downhole tool (e.g., packer, plug, anchor, etc.) positioned within a wellbore.

Turning to FIG. 5, illustrated is an alternative embodiment of a downhole tool 500. The downhole tool 500 shares many of the same features as the downhole tool 400. Accordingly, like reference numbers have been used to illustrate similar, if not identical, features. In the illustrated embodiment of FIG. 5, the downhole localized heater 530 is positioned on an exterior of the downhole tubular 410, for example between a pair of expandable metal members 520*a*, 520*b*. The downhole localized heater 530, similar to the downhole localized heater 430, may include a heating section 540 and a control section 545. Thus, whereas the downhole localized heater 430 provides a localized increase in temperature from the inside of the downhole tubular 410, the downhole localized heater 530 provides a localized increase in temperature from the outside of the downhole tubular 410.

Figure 6:
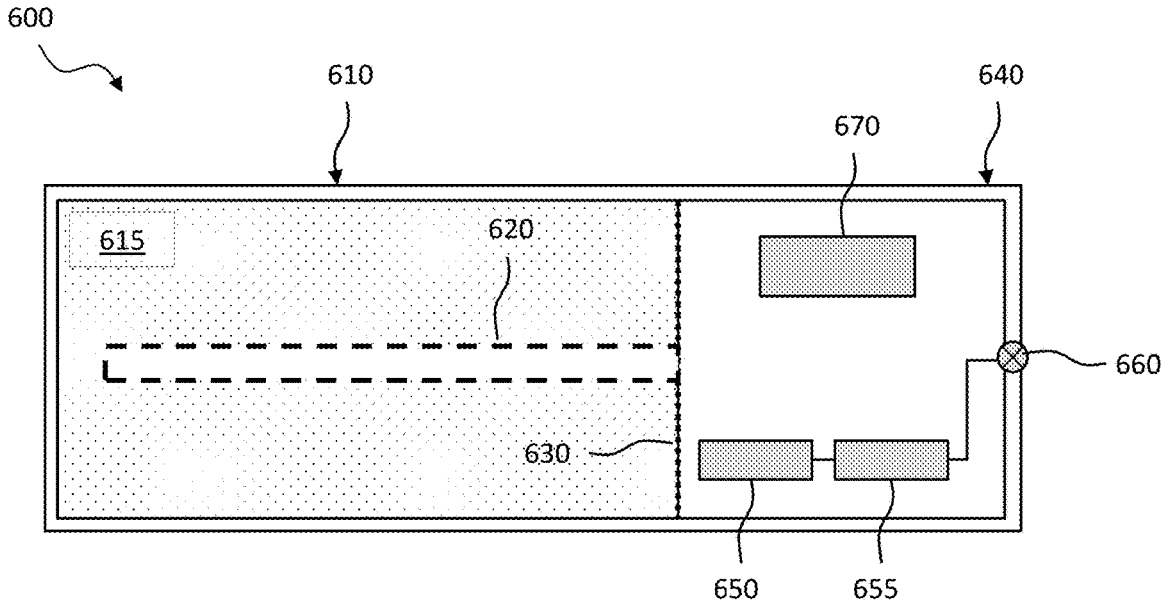
FIGS. 6-7 illustrate various different configurations for a downhole localized heater designed, manufactured and operated according to one embodiment of the disclosure.

Turning now to FIG. 6, illustrated is a downhole localized heater 600 designed, manufactured and operated according to one embodiment of the disclosure. The downhole localized heater 600, in the illustrated embodiment, is a chemical heater that employs exothermic reactants to provide the localized temperature increase. The downhole localized heater 600, in the embodiment shown, includes a heating section 610 and a control section 640.

In accordance with this embodiment, the heating section 610 includes an amount of exothermic reactants 615 contained therein. The specific exothermic reactant 615 may vary based upon the design of the downhole localized heater 600, but in one embodiment the exothermic reactant 615 is configured to react based upon contact with wellbore fluid. The heating section 610 additionally includes a flow path 620, which could be used to help distribute the activation fluid with the exothermic reactants 615.

Separating the heating section 610 and the control section 640, in the embodiment of FIG. 6, is an optional barrier 630. The barrier 630, in the illustrated embodiment, may be a dissolvable barrier layer or rupturable barrier layer, among others, that separates the exothermic reactants 615 from the components of the control section 640 until it is desired to generate the localized temperature spike. The barrier layer may be a metal, a paper, a polymer, a glass, or a ceramic. In one embodiment, the exothermic reactants 615 are encapsulated by a barrier layer created by a polymeric film.

The control section 640, in the illustrated embodiment, includes a power source 650 (e.g., such as a battery), a controller 655, and a valve 660. In this embodiment, the power source 650 and controller 655 open the valve 660 at a desired point in time. With the valve 660 open, the wellbore fluid may enter inside of the downhole localized heater 600, and after the barrier 630 dissolves or is ruptured, allow the wellbore fluid to chemically react with the exothermic reactant 615 to generate the localized temperature spike. The control section 640 may open the valve 660 based upon a timer, a transmitted signal through a wire, a transmitted signal sent wirelessly, or from a sensing of the operation of the wellbore, among other mechanisms. For example, a pressure change or temperature change through fluid swapping could be used as the signal to trigger the control section 640 to open the valve 660. The downhole localized heater 600 illustrated in FIG. 6 additionally includes an optional fusible alloy 670. The fusible alloy 670 helps to regulate the temperature through the heat of fusion.

Figure 7:
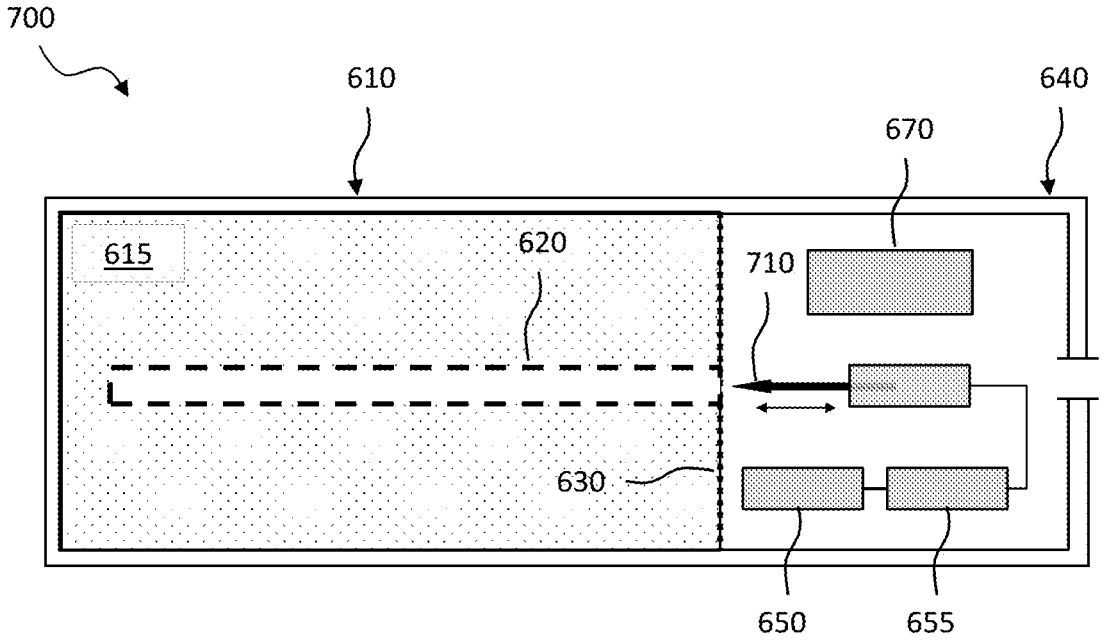

Turning now to FIG. 7, illustrated is a downhole localized heater 700 designed, manufactured and operated according to another embodiment of the disclosure. The downhole localized heater 700 shares many of the same features as the downhole localized heater 600. Accordingly, like reference numbers have been used to illustrate similar, if not identical, features. In the illustrated embodiment of FIG. 7, the downhole localized heater 700 does not include a valve 660, but allows the wellbore fluid to interact with an interior of the control section 640 at all times. The downhole localized heater 700, however, employs a rupture tool 710 to rupture the barrier 630 to allow the wellbore fluid to chemically react with the exothermic reactant 615 to generate the localized temperature spike. In another variation, the reactive fluid is carried into the wellbore with the chemical heater.

While FIGS. 6 and 7 have illustrated the use of a control section 640, in an alternative embodiment there are no electronics in the system. For example, in another embodiment a degradable section of the housing degrades and allows the reaction to initiate. For example, the housing could be constructed from a dissolvable polymer. No reaction occurs until the housing dissolves. As the housing is breached, then water hits the reactants and heat is generated. Degradable housings include dissolvable metals, dissolvable polymers, and melt-able materials (fusible alloys), among others.

In one embodiment, the downhole localized heater features an exothermal hydration reaction. Water-based wellbore fluids chemically react with the reactant. In one example, the reactant is a metal that oxidizes with the water. For example, magnesium powder will react with salt water and generate heat. This could also be performed with aluminum, silicon, iron, zinc, lithium, calcium, or sodium.

In another example embodiment, the reactant is a metal oxide that reacts with water, such as calcium oxide that reacts with water to produce $CaO+H_2O \rightarrow Ca(OH)_2$ and 63.7 KJ/mol of CaO. One liter of water will react with about 3.08 kg (e.g., about 6.8 pounds) of CaO to produce calcium hydroxide and 3.54 MJ of heat. Other alkali metal oxides could be used, especially BaO or SrO. In another example, the reactant is an anhydrous salt such as anhydrous calcium chloride. The heat of solution provides the heat.

In another embodiment, the speed of the reaction is increased by adding galvanic powder to the reactant. The galvanic powder has a higher galvanic potential than the reactant and will accelerate the chemical reaction. For example, iron powder could be added to magnesium reactant. Other notable galvanic powders includes iron, nickel, copper, carbon, titanium, aluminum, tin, zinc or any other material that is more cathodic than the reactant.

The reaction speed can also be accelerated by combining anhydrous acid with the metal powder, such as anhydrous citric acid. In the preferred embodiment, the anhydrous acid forms citric acid in the presence of water. In alternative embodiments, the anhydrous acid forms hydrochloric acid, trichloroacetic acid, perchloric acid, acetic acid, nitric acid, oxalic acid, steric acid, boric acid, maleic acid, phosphoric acid, or formic acid. The acid can be a carboxylic acid, a dicarboxylic acid, a tricarboxylic acid, a mineral acid, or an organic acid including but not limited to aromatic anhydrides, organic esters, formates, ortho-formates or the like. For example, the anhydrous acid could be urea hydrochloride which liberates hydrochloric acid when exposed to a water-based fluid. It could also be phosphorous pentoxide or phosphonate ester to generate phosphoric or organo-phosphoric acid. Maleic anhydride would generate maleic acid. Formic acid anhydrous would generate formic acid. Combinations are also possible, for example acetic formic anhydride will generate acetic acid and formic acid. Additionally, there are other solid metallic salt compounds which lower the pH (thus increasing the speed of the reaction) when exposed to an aqueous environment. These include, without limitation, metal halide salts like $AlCl_3$, $NiCl_2$, $NiBr_2$ (to name a few) that when exposed to water form the corresponding inorganic acids (e.g., HCl, and HBr).

The reaction speed can be accelerated by adding a salt to the metal powder. Example salts include NaCl, KCl. The salt can also be an oxidizer, such as $NaNO_3$, $KNO_3$. In one example, the reactant in the heater comprises (by weight) 90% magnesium, 4% iron, 5% anhydrous citric acid, and 1% NaCl. In another embodiment, the chemical reaction reacts without generating gas while generating minimal gas. For example, the reaction can be $Mg+CuCl_2$ or can be $CuSO_4+Zn \rightarrow ZnSO_4+Cu$.

The chemical heater can also feature a thermite reaction, or a chemical battery.

Aspects disclosed herein include:

A. A method for setting a downhole tool, the method including: 1) positioning a downhole tool within a wellbore, the downhole tool including expandable metal configured to expand in response to hydrolysis; 2) positioning a downhole localized heater within the wellbore, the downhole localized heater being proximate the expandable metal; and 3) subjecting the expandable metal to a wellbore fluid to expand the expandable metal into contact with one or more surfaces while activating the downhole localized heater to create a temperature spike and accelerate an expansion of the expandable metal.

B. A downhole localized heater, the downhole localized heater including: 1) an enclosure; 2) a heating section located within the enclosure, the heating section including exothermic reactants contained therein; and 3) a control section located within the enclosure, the control section operable to allow reactant fluid to react with the exothermic reactants and create a temperature spike after a period of time.

Aspects A and B may have one or more of the following additional elements in combination: Element 1: wherein the downhole localized heater is configured to increase a relative rate of reaction by at least 2×. Element 2: wherein the downhole localized heater is configured to increase a relative rate of reaction by at least 5×. Element 3: wherein positioning the downhole localized heater within the wellbore includes lowering the downhole localized heater within the wellbore proximate the downhole tool using a downhole conveyance. Element 4: wherein the downhole tool includes a tubular having the expandable metal located on an outside thereof, and further wherein the downhole localized heater is lowered within the tubular proximate the expandable metal. Element 5: wherein the downhole localized heater is movable relative to the expandable metal as the expandable metal is subjected to the wellbore fluid. Element 6: wherein the downhole tool includes a tubular having the expandable metal located on an outside thereof, and further wherein the downhole localized heater is located proximate the expandable metal outside of the tubular. Element 7: wherein the downhole localized heater is fixed relative to the expandable metal as the expandable metal is subjected to the wellbore fluid. Element 8: wherein the downhole localized heater includes a heating section and a control section. Element 9: wherein the heating section includes exothermic reactants contained within an enclosure. Element 10: wherein the enclosure includes a valve operable to move from a closed state to an open state to allow reactant fluid to enter the enclosure and react with the exothermic reactants. Element 11: wherein the heating section and the control section are located within the enclosure, and further wherein a barrier within the enclosure separates the heating section from the control section. Element 12: further including a rupture tool located within the enclosure, the rupture tool configured to rupture the barrier after a period of time to allow reactant fluid to react with the exothermic reactants. Element 13: wherein the reactant fluid is fully contained within the enclosure. Element 14: wherein the reactant fluid is wellbore fluid. Element 15: wherein the downhole localized heater further includes a fusible alloy located within the enclosure, the fusible alloy operable to regulate a temperature of the downhole localized heater through the heat of fusion. Element 16: wherein the enclosure includes a valve operable to move from a closed state to an open state to allow the reactant fluid to enter the enclosure and react with the exothermic reactants and create the temperature spike. Element 17: wherein a barrier within the enclosure separates the heating section from the control section. Element 18: wherein further including a rupture tool located within the enclosure, the rupture tool configured to rupture the barrier after the period of time to allow the reactant fluid to react with the exothermic reactants. Element 19: wherein the reactant fluid is fully contained within the enclosure. Element 20: further including a fusible alloy located within the enclosure, the fusible alloy operable to regulate a temperature of the downhole localized heater through the heat of fusion.

Those skilled in the art to which this application relates will appreciate that other and further additions, deletions, substitutions and modifications may be made to the described embodiments.

What is claimed is:

1. A method for setting a downhole tool, comprising:

positioning the downhole tool within a wellbore, the downhole tool including electrically conductive expandable metal configured to expand in response to hydrolysis, the expandable metal including an alkaline earth metal or a transition metal;

positioning a downhole localized heater within the wellbore, the downhole localized heater being proximate the expandable metal; and subjecting the expandable metal to a wellbore fluid to expand the expandable metal into contact with one or more surfaces while activating the downhole localized heater to create a temperature spike and accelerate an expansion of the expandable metal, wherein while subjecting the expandable metal to the wellbore fluid the expandable metal goes from metal to micron scale particles that expand and lock together.

2. The method as recited in claim 1, wherein subjecting the expandable metal includes subjecting the expandable metal to the wellbore fluid to expand the expandable metal into contact with the one or more surfaces while activating the downhole localized heater to create the temperature spike of at least 10° C.

3. The method as recited in claim 1, subjecting the expandable metal includes subjecting the expandable metal to the wellbore fluid to expand the expandable metal into contact with the one or more surfaces while activating the downhole localized heater to create the temperature spike of at least 25° C.

4. The method as recited in claim 1, wherein positioning the downhole localized heater within the wellbore includes lowering the downhole localized heater within the wellbore proximate the downhole tool using a downhole conveyance.

5. The method as recited in claim 4, wherein the downhole tool includes a tubular having the expandable metal located on an outside thereof, and further wherein the downhole localized heater is lowered within the tubular proximate the expandable metal.

6. The method as recited in claim 4, wherein the downhole localized heater is movable relative to the expandable metal as the expandable metal is subjected to the wellbore fluid.

7. The method as recited in claim 1, wherein the downhole tool includes a tubular having the expandable metal located on an outside thereof, and further wherein the downhole localized heater is located proximate the expandable metal outside of the tubular.

8. The method as recited in claim 1, wherein the downhole localized heater is fixed relative to the expandable metal as the expandable metal is subjected to the wellbore fluid.

9. The method as recited in claim 1, wherein the downhole localized heater includes a heating section and a control section.

10. The method as recited in claim 9, wherein the heating section includes exothermic reactants contained within an enclosure.

11. The method as recited in claim 10, wherein the enclosure includes a valve operable to move from a closed state to an open state to allow reactant fluid to enter the enclosure and react with the exothermic reactants.

12. The method as recited in claim 10, wherein the heating section and the control section are located within the enclosure, and further wherein a barrier within the enclosure separates the heating section from the control section.

13. The method as recited in claim 12, further including a rupture tool located within the enclosure, the rupture tool configured to rupture the barrier after a period of time to allow reactant fluid to react with the exothermic reactants.

14. The method as recited in claim 13, wherein the reactant fluid is fully contained within the enclosure.

15. The method as recited in claim 13, wherein the reactant fluid is the wellbore fluid.

16. The method as recited in claim 10, wherein the downhole localized heater further includes a fusible alloy located within the enclosure.

* * * * *